US006888079B2

(12) United States Patent
Altmann

(10) Patent No.: US 6,888,079 B2
(45) Date of Patent: May 3, 2005

(54) MULTIFUNCTIONAL PUSHBUTTON SWITCH

(75) Inventor: Markus Altmann, Moos (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 10/634,677

(22) Filed: Aug. 5, 2003

(65) Prior Publication Data

US 2004/0089526 A1 May 13, 2004

(30) Foreign Application Priority Data

Aug. 8, 2002 (DE) ..... 202 12 255 U

(51) Int. Cl.[7] ..... H01H 9/00; H01H 11/00; H01H 13/705

(52) U.S. Cl. ..... 200/61.54; 200/5 A; 200/341

(58) Field of Search ..... 200/61.54–61.57, 200/302.1–302.3, 341–345, 520–536, 308, 311, 314, 565

(56) References Cited

U.S. PATENT DOCUMENTS

| | | | | |
|---|---|---|---|---|
| 3,978,297 A | | 8/1976 | Lynn et al. | |
| 4,634,818 A | | 1/1987 | Hayes-Pankhurst et al. | |
| 4,638,131 A | * | 1/1987 | Kidd et al. | 200/61.55 |
| 5,021,638 A | | 6/1991 | Nopper et al. | |
| 5,359,658 A | | 10/1994 | Goodson | |
| 6,680,450 B2 | * | 1/2004 | Frohne et al. | 200/565 |
| 2004/0089530 A1 | * | 5/2004 | Schmon et al. | 200/520 |

FOREIGN PATENT DOCUMENTS

| | | | | |
|---|---|---|---|---|
| DE | 4016122 | | 11/1990 | |
| DE | 19605201 | | 8/1997 | |
| DE | 19653166 | | 6/1998 | |
| DE | 19178677 | | 11/1998 | |
| DE | 19740382 | | 3/1999 | |
| DE | 19915969 | | 11/1999 | |
| DE | 29811378 | | 12/1999 | |
| DE | 10112006 | | 9/2001 | |
| DE | 10131219 | | 3/2003 | |
| DE | 10157329 | | 3/2003 | |
| EP | 0486388 | | 5/1992 | |
| GB | 2168537 | | 6/1986 | |
| GB | 2234115 | | 1/1991 | |
| GB | 2353762 A | * | 3/2001 | H01H/25/04 |
| WO | WO 00/13396 | | 3/2000 | |

* cited by examiner

*Primary Examiner*—James R Scott
(74) *Attorney, Agent, or Firm*—Tarolli, Sundheim, Covell & Tummino L.L.P.

(57) ABSTRACT

A multifunctional pushbutton switch for a vehicle steering wheel has a plurality of pushbutton switching units with pushbutton surfaces that are close to each other in a common operating surface. The switch has a common switch housing in which actuation tappets of the pushbutton switching units are movably guided. A cap is mounted onto the switch housing. The cap is made by means of a two-component injection-molding technique of a relatively rigid plastic frame with a cutout window whose shape and size correspond to the circumference of a pushbutton surface and of a silicone membrane stretched over the window.

8 Claims, 2 Drawing Sheets

MULTIFUNCTIONAL PUSHBUTTON SWITCH

FIELD OF THE INVENTION

The invention relates to a multifunctional pushbutton switch with several pushbutton switching units whose pushbutton surfaces are close to each other in a shared operating surface, especially for a vehicle steering wheel, with a shared switch housing in which the actuation tappets of the pushbutton switching units are configured so that they can move.

BACKGROUND OF THE INVENTION

With multifunctional button switches, especially in multifunction steering wheels for vehicles, the individual pushbutton switches are grouped next to each other and they project individually from openings of a cover. As a result, they can be felt and operated without eye contact. The assembly of such a multifunctional pushbutton switch, however, is highly complicated.

BRIEF SUMMARY OF THE INVENTION

The invention provides a multifunctional pushbutton switch that can be visually and functionally well integrated into an existing environment, especially into the steering wheel of a vehicle. The multifunctional pushbutton switch according to the invention has a cap that is made by means of a two-component injection-molding technique and that is mounted onto the actuation tappets and onto the switch housing. The cap consists of a relatively rigid plastic frame with a cutout window whose shape and size correspond to the circumference of the pushbutton surfaces and consists of a silicone membrane stretched over the window. In this manner, the multifunctional pushbutton switch has a completely contiguous operating surface that is formed by the outer surface of the silicone membrane. The actuation tappets of the pushbutton switching units can be felt through the silicone membrane and can be actuated by pressure exerted on the outer surface of the silicone membrane. The silicone membrane preferably extends continuously over the entire outer surface of the cap, which is integrated into the surface of the steering wheel body.

In the case of multifunctional pushbutton switches whose individual pushbutton surfaces lie closely adjacent to each other, the possibility exists that several pushbuttons might be actuated at the same time. This can be prevented if the rigid plastic frame is provided with a dividing cross that delineates the pushbutton surfaces from each other and that, at the same time, supports the silicone membrane. However, one embodiment of the invention takes another approach. It has namely been found that, due to the greater shrinkage of the silicone in comparison to the material of the rigid plastic frame, unsightly deformations of the membrane surface occur at the plastic/silicone transitions. For this reason, in one embodiment of the invention, the individual pushbutton surfaces of the pushbutton switching units are delineated by guide walls of the switch housing that are arranged between the actuation tappets and that extend all the way to the inner surface of the silicone membrane. The actuation tappets are preferably pressed resiliently against the inner surface of the silicone membrane, but are retained by stop members in their unactuated resting positions. These stop members are formed by projections like latching noses that are molded onto the actuation tappets and that interact with the abutment surfaces that are clipped onto the housing and that face away from the silicone membrane. The multifunctional pushbutton switch preferably has an altogether convex operating surface.

Additional features and advantages of the invention ensue from the following description of a preferred embodiment and from the drawing to which reference is made. The drawing shows the following:

DETAILED DESCRIPTION OF THE INVENTION

Figure 1:
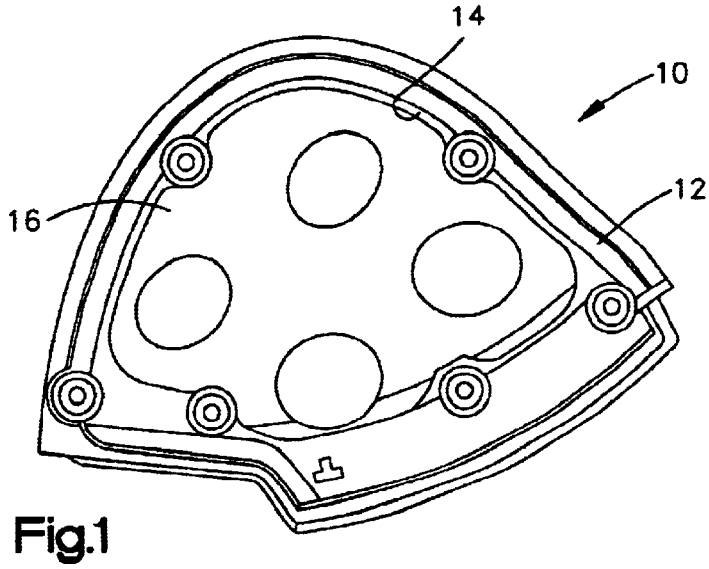
FIG. 1 shows a top view of the inside of a cap.
Figure 3:
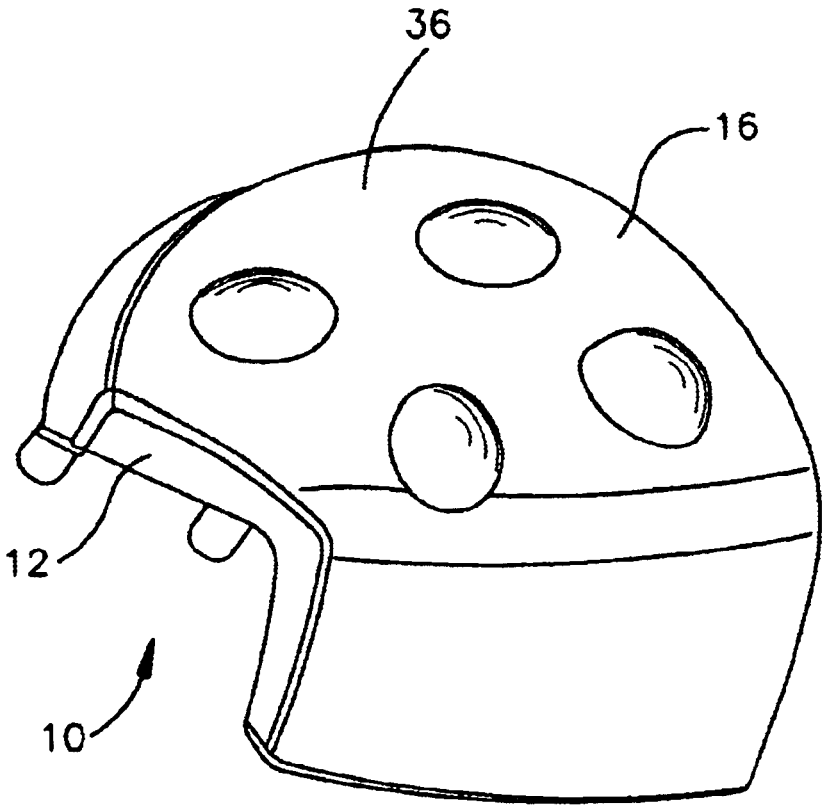
FIG. 3 shows a perspective view of the cap.

The cap of a multifunctional pushbutton switch generally designated with the reference numeral 10 in FIGS. 1 and 3 has a frame 12 made of relatively rigid plastic that surrounds a cutout window 14, over which a silicone membrane 16 is stretched. The silicone membrane 16 forms a completely contiguous operating surface on the outer surface of the cap.

Figure 2:
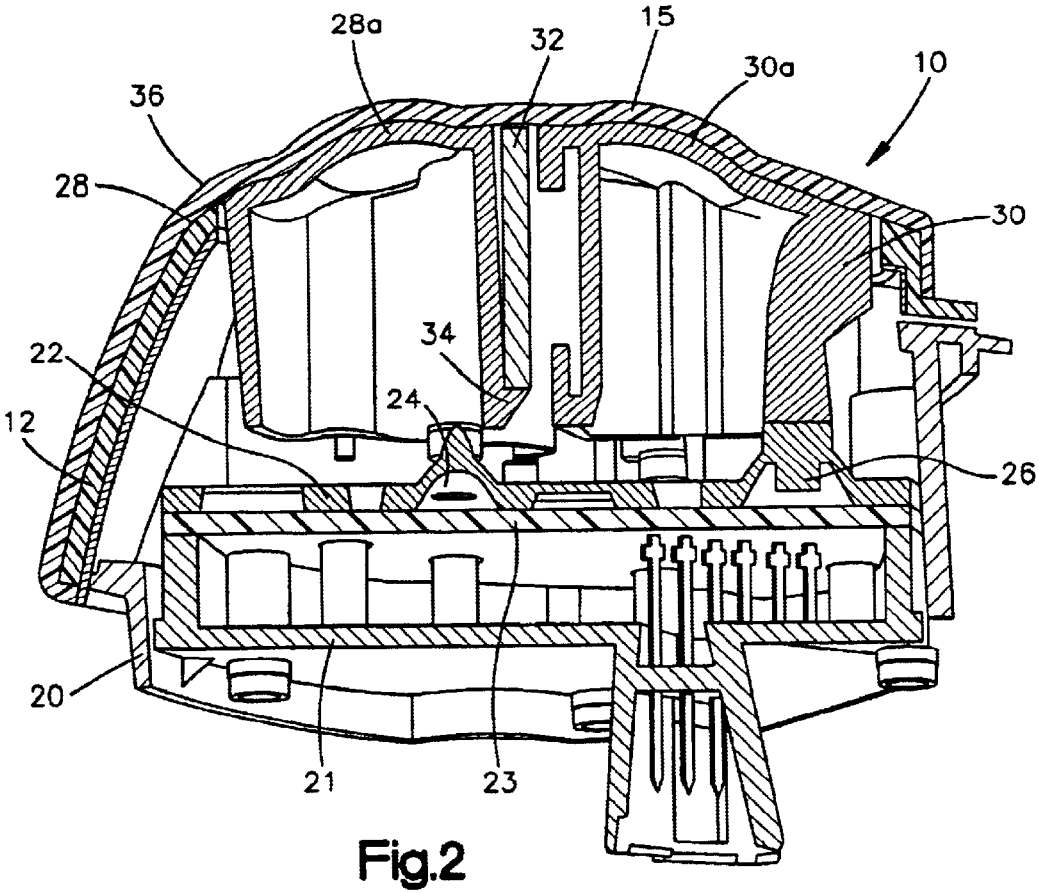
FIG. 2 shows a sectional view of the multifunctional pushbutton switch.

FIG. 2 shows a switch housing 20 onto which the cap 10 has been placed. A baseplate 21 having a switching mat 22 on a printed circuit board 23 is inserted into the switch housing 20. The switching mat 22 has shaped-in domes with contact tabs as movable contacts 24, 26 that are each actuated by an actuation tappet 28 or 30. Of the total of four actuation tappets of the multifunctional pushbutton switch, only the actuation tappets 28 and 30 can be seen in FIG. 2. A guide wall 32 of the switch housing 20 extends between the actuation tappets 28, 30, said wall reaching the inner surface of the silicone membrane 16. The actuation tappets 28, 30 are pressed against the silicone membrane 16 from the inside, giving it a convex curvature. Stop member 34 retains actuation tappets 28 and 30 in their unactuated resting positions. Stop member 34 is formed by molded projections on the actuation tappets 28, 30. On its actuation surface lying against the inner surface of the silicone membrane 16, each actuation tappet 28, 30 has a convex curvature 28*a* or 30*a* or a concave indentation that can be felt through the membrane.

The cap 10 consisting of the frame 12 and of the silicone membrane 16 is manufactured as a two-component injection-molded part. The outer surface of the frame 12 is completely covered by a continuous layer of silicone material forming common operating surface 36. Between the material of the frame 12 and the layer of silicone material, there is an inter-material bond that can be mechanically stressed and that is splash-proof. Since the layer of silicone material engages behind the outer circumference of the frame, there is also a shape fit connection that further increases the mechanical stressability. Moreover, this creates not only a completely contiguous operating surface over the actuation tappets, but also a visually attractive appearance. If the operating surface is to be labeled, for example, with symbols indicating the function of the individual pushbutton switches, then a high positional accuracy is ensured since the rigid frame 12 cannot shift with respect to the silicone layer that covers it. In this case, the operating surface is preferably first provided in a (white) symbol color and then coated in a dark color. The dark color is then selectively cut away in the form of the symbols by means of a laser.

What is claimed is:

1. A multifunctional pushbutton switch comprising a plurality of pushbutton switching units having actuation tappets and pushbutton surfaces, said pushbutton surfaces being arranged close to each other in a common operating surface, a common switch housing with guiding means for movably guiding said actuation tappets in said switch housing, a cap mounted onto said common switch housing, said cap comprising a relatively rigid plastic frame with one cutout window, said one cutout window corresponding in shape and size to the circumference of the pushbutton surfaces, said cap further comprising a silicone membrane stretched over said one cutout window and an outer surface of said silicone membrane forming said common operating surface.

2. The multifunctional pushbutton switch according to claim 1, wherein guide walls of the switch housing extend all the way to the inner surface of the silicone membrane between the actuation tappets.

3. The multifunctional pushbutton switch according to claim 1, wherein the actuation tappets are pressed resiliently against the inner surface of the silicone membrane and are limited in their movement to their unactuated resting by stop members.

4. The multifunctional pushbutton switch according to claim 3, wherein the stop members are formed by projections that are molded onto the actuation tappets and that interact with abutment surfaces on the housing that face away from the silicone membrane.

5. The multifunctional pushbutton switch according to claim 1, wherein said common operating surface formed by the outer surface of the silicone membrane has an altogether convex curvature.

6. The multifunctional pushbutton switch according to claim 1, wherein the actuation tappets have a curvature or indentation that can be felt through the silicone membrane and that is located on the operating surface that lies against the inner surface of the silicone membrane.

7. The multifunctional pushbutton switch according to claim 1, wherein the plastic frame and the silicone membrane are joined with an inter-material bond.

8. The multifunctional pushbutton switch according to claim 7, wherein the silicone membrane engages around the outer circumference of the plastic frame with a shape fit.

* * * * *